US005692971A

United States Patent [19]

Williams

[11] Patent Number: 5,692,971

[45] Date of Patent: Dec. 2, 1997

[54] SHOCK ABSORBING INSERT AND OTHER SPORTING GOODS IMPROVEMENTS

[76] Inventor: Danny R. Williams, 3041 Green Tee Dr., Pearland, Tex. 77581

[21] Appl. No.: 612,983

[22] Filed: Mar. 6, 1996

[51] Int. Cl.[6] ..... A63B 53/10; A63B 53/12; A63B 59/00; A63B 49/08

[52] U.S. Cl. ..... 473/318; 473/520

[58] Field of Search ..... 473/318, 323, 473/332, 300, 301, 302, 303; 273/72 A, 75, 73, 73 J

[56] References Cited

U.S. PATENT DOCUMENTS

| | | | |
|---|---|---|---|
| 1,950,342 | 3/1934 | Meshel | 473/300 |
| 2,023,131 | 12/1935 | Gibson | 473/318 |
| 3,729,196 | 4/1973 | Heald | 273/72 A |
| 4,271,608 | 6/1981 | Tomuro | 36/61 |
| 4,431,187 | 2/1984 | Rumble | 473/323 |
| 4,621,813 | 11/1986 | Solheim | 473/290 |
| 5,034,082 | 7/1991 | Nolan | 273/73 J |
| 5,122,405 | 6/1992 | Landi | 473/318 |
| 5,219,164 | 6/1993 | Peng | 273/72 A |
| 5,312,105 | 5/1994 | Cleveland | 473/350 |
| 5,316,298 | 5/1994 | Hutin et al. | 473/332 |
| 5,362,046 | 11/1994 | Sims | 273/73 R |
| 5,511,777 | 4/1996 | McNeely | 273/72 A |

*Primary Examiner*—Sebastiano Passaniti
*Assistant Examiner*—Stephen L. Blau
*Attorney, Agent, or Firm*—Pravel, Hewitt, Kimball & Krieger

[57] ABSTRACT

An elongate tube of resilient material is fitted into a golf club shaft to reduce the transfer of impact shock to a golfer's hands, shoulders and arms. The tube is compressively fitted into the club shaft to protect against its slippage or movement within the shaft. The tube when inserted also does not alter or affect club balance. For additional shock absorbency, the club face may be isolated from the remainder of the club head by a layer of resilient, shock-absorbent material. The tube may also be used as an insert in shafts or handles of other types of sporting goods.

20 Claims, 3 Drawing Sheets

SHOCK ABSORBING INSERT AND OTHER SPORTING GOODS IMPROVEMENTS

BACKGROUND OF INVENTION

1. Field of Invention

The present invention relates to reduce the effects of vibrations or shock on users of sporting goods, and particularly those playing golf.

2. Description of Prior Art

In a number of sports, contestants are required to strike or hit a ball with a club, bat or the like. Examples of such sports are golf, tennis, baseball and softball. Using golf as an example, vibrations are known to result in the shaft of the golf club when the ball is struck. These vibrations are transferred through to the golfer's hands, arms and shoulders. It has been recognized that the shock of impact and the ensuing vibrations causes stress on body joints of golfers and other athletes in these circumstances. There have been recent attempts to reduce the problem.

One way attempted has been to place vibration dampening inserts into various positions of the golf club head, as exemplified by U.S. Pat. No. 5,316,298. There have been concerns expressed by some over the ability of club head dampeners to lessen transfer of shock to the golfer's hands. Another approach was that of U.S. Pat. No. 5,362,046 which attached a form of dampener at the open or free end of the golf club shaft. Both types of apparatus, however, had drawbacks. Among other things, they changed the balance and feel of a golf club when they were added to it. Such a change was usually perceptible to a user of the club, and often could or would affect the caliber of play. If the club was purchased as a new one, golfers might be less likely to notice any difference, since they would be using a new club. This of course meant the expense of a completely new club, or a new set of clubs. However, inclusion of shock absorbing devices as a retrofit to one or more clubs or the full set of clubs often significantly changed the balance or feel of the particular club set. This was undesirable, since it could alter the golfer's swing and thus affect the golfer's playing ability and skill.

Recent advances in golf club shaft technology with use of graphite or other composite material shafts has also somewhat eased the shock and vibration problem. However, graphite shafts for golf clubs were more expensive than steel shafts. Thus, cost was a consideration as well, particularly if vibration protection was desired for all of the clubs, both woods and irons.

SUMMARY OF INVENTION

Briefly, the present invention provides a new and improved shock absorbent insert for a shaft of an item of sporting goods or equipment. The shaft of the item extends between a user's hand grip at one end and an opposite end. The insert according to the present invention absorbs shock and vibration when the sporting goods item is used for play or practice. The insert is formed from an elongate tube of resilient material which has an outer surface conforming to the interior of the shaft. The tube of resilient material has a tapered inner surface along the extent of the shaft from one end to the opposite end. The inner and outer surfaces of the elongate tube have dimensions which cause the tube to exhibit uniform mass per unit length along the shaft. In this manner, balance of the shaft in a user's hand or hands is not affected by the presence of the insert.

The shock absorbent insert of the present invention may be used with a wide number of types of sporting goods items such as golf clubs, baseball or softball bats, tennis rackets, rackets for other sports and the like.

DETAILED DESCRIPTION OF THE PREFERRED EMBODIMENT

Figure 1A:
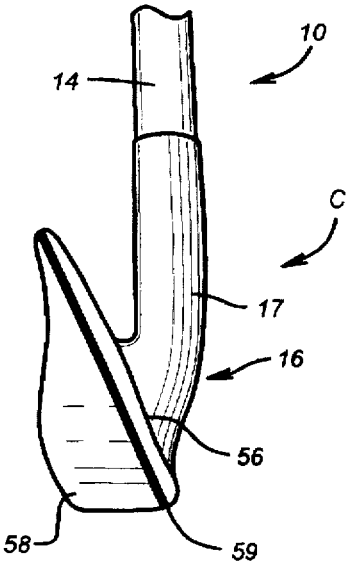
FIGS. 1A, 1B and 1C are isometric views of a golf club having shock absorbent features according to the present invention.
Figure 1B:
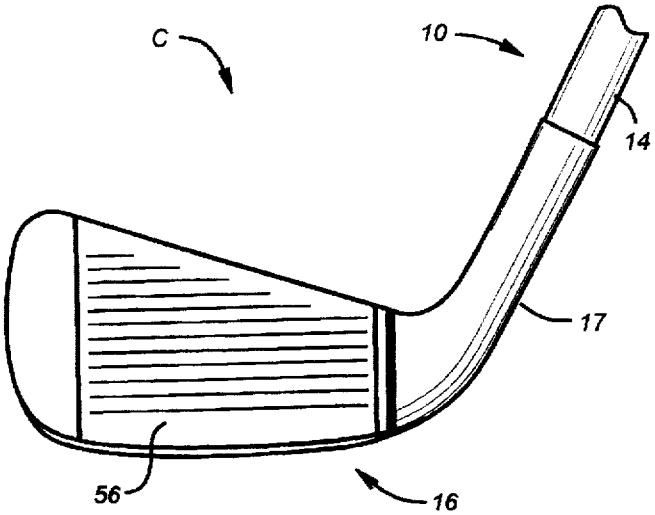
Figure 1C:
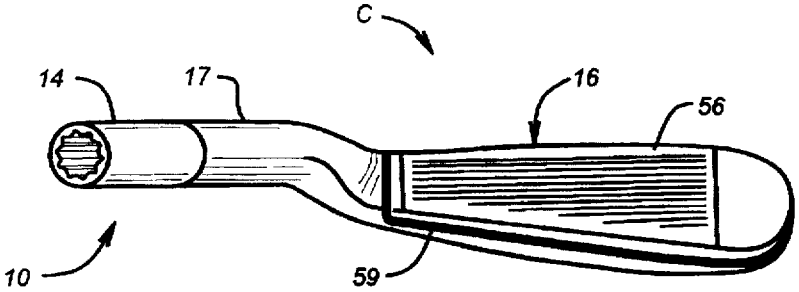

In the drawings, the letter C designates generally a golf club (FIGS. 1–5) according to the present invention for reducing the effect of vibrations or shock on users of such an item of sporting goods when playing or practicing that sport. As will be set forth, the present invention also provides structure for reducing the effect of vibration or shock on users of other types of other equipment or sporting goods items, including a bat B (FIGS. 6–9) for baseball or softball and a sports racket R for tennis or some other generally similar sport, such as racquetball, paddle ball, squash or the like.

Considering the golf club C more in detail, a hollow club shaft 10 (FIGS. 1 & 2) having an open center or passage 11 adjacent an inner wall 10*a*. The shaft 10 is usually formed of steel or some other suitable metal extending from an upper portion 12, over which a conventional user's hand grip is adapted to be fitted. The club shaft 10 extends to a lower portion 14 to which a club head 16 is mounted at a hosel 17. The club shaft 10 (FIG. 2) is typically formed of a series of one or more stepped diameter segments, as indicated at 18, 20, 22, 24 and 26 of decreasing outer diameter between the upper portion 12 and lower portion 14.

According to the present invention, an insert I (FIGS. 3–5) is provided for fitting into the interior of the club shaft 10 in firm contact with the inner wall portions 10*a* along its length. The insert I serves to absorb shock and vibrations when the club C is used. According to the present invention, the insert I (FIGS. 3–5) takes the form of an elongate tube 30 of resilient material having an outer surface 32 conforming to the interior wall 10*a* of the golf club shaft 10. Thus, the outer surface 32 of the insert I has a corresponding series of stepped diameter segments 34, 36, 38, 40, and 42 of decreasing diameter between an upper portion 44 and a lower portion 46.

The resilient material of the insert I is preferably formed from a suitable type of commercially available closed cell neoprene sponge material. A particularly suitable such material is that sold under the trademark PRESST-O-CELL® sold by United Technology Automotive of St. Louis, Mo. It should be understood, however, that other closed cell synthetic resin sponge materials or neoprene or other material of comparable shock-absorbent characteristics might also be used as well.

The outer diameter of the tube 30 of insert I is slightly larger than the inner diameter of the wall 10*a* of the club shaft 10 at each of the successive stepped diameter segments along its length. In this manner, the insert I is compressively fitted in place within the club shaft 10 on installation and thus is in firm contact with the inner wall 10*a* of the club shaft for shock absorption purposes. The compressive fitting also serves to prevent relative movement between the shaft 10 and insert I. The insert I can be installed by a pronged rod or probe which is slid into the interior of insert I to firmly engage it. The insert I is then longitudinally slid or stuffed downwardly into the shaft 10 from the open upper end 12, after which a conventional club grip may be fitted in place.

The elongate tube 30 of the insert I additionally has a hollow center opening passage or portion 48 extending from the upper portion 44 to the lower portion 46. The tube 30 of the insert I also has a tapered inner surface 50 along its inner extent adjacent the center opening 48 from the upper portion 44 to the lower portion 46. According to the present invention, the larger diameter upper segments such as 34, 36, and 38 are comparatively thinner than those of the smaller outer diameter lower segments such as 40 and 42. In this manner, there is an outward tapering of the inner surface 50 of the tube 32 along the inner extent between upper portion 44 and lower portion 46. The particular dimensions and extent of taper selected vary from club to club and manufacturer to manufacturer. However, it is preferable that the taper and both inner and outer diameter of the insert I are chosen to cause the insert I to exhibit uniform mass per unit length along its longitudinal extent from the upper portion 44 to the lower portion 46.

In this manner, when the insert I is placed in the golf club shaft 10, balance of the shaft 10 in a user's or player's hands is not effected by inclusion of the insert I into the club C. The tapered inner surface 50 of the tube 32 of the insert I is also preferably fluted, having in the embodiment shown about ten alternating ridges 52 and grooves 54 formed in the inner surface in order to reduce weight of the insert I. This fluting may also be adjusted in depth to assist in achieving uniform mass per unit length.

For additional shock absorption purposes, the head 16 (FIG. 1) of the golf club C may be modified so that a club face segment 56 is a separate element from a back portion 58 by a shock absorptive pad 59 of a like material to that of the insert I. The club head pieces 56, 58, and 59 are preferably adhesively attached to each other by some suitable epoxy or high strength adhesive resin, or by some other suitable metal-rubber bonding process. The club head pieces are of like surface area and extent and are of mating and corresponding outer dimensions for ease of club head movement with minimal wind drag during club swing.

As has been set forth above, the present invention is adapted for use with other forms of sporting goods, such as the baseball or softball bat B (FIGS. 6–9). In the bat B, a bat member 60, typically of metal, is provided extending between an inner end or grip portion 62 which is adapted to be gripped by a batter or player and an outer end 64 of a barrel portion 66. The bat 60 is preferably formed of aluminum or some other suitable metal, having an open center portion 61 adjacent a bat inner wall. The bat 60 also typically includes a knob 63 inwardly of the grip 62 and a cap or end closure 65 for fitting over the outer end 64 for closure purposes. As was the case with the insert I, an insert I-1 (FIGS. 7–9) is provided for inclusion in the bat B according to the present invention. The insert I-1 is an elongate tube 70 of resilient material having an outer surface 72 conforming to the interior wall 60*a* of the bat or shaft. The elongate tube 70 in insert I-1 is preferably formed of a material of like characteristics to that of the insert I. The tube 70 also tapers along its extent from an outer end 74 at the outer end 64 in varying wall thickness at portions along its length such as at 76, 78, 80 and 82 according to the inner diameter of the wall 60*a* of the bat 60. The vanting wall thicknesses are coordinated with the bat wall inner diameter to achieve uniform weight mass per unit length of the bat B with the insert I-1. Since the bat B is not of decreasing diameter along its length as was the golf club shaft 10, the taper of the insert I-1 along its length is not uniform. The wall thickness of the insert I-1 is chosen to have dimensions which cause the elongate tube 70 to exhibit uniform mass per unit length along the bat B. In this manner, balance of the bat in the hands of a batter or user is not affected by the insert I-1. Again, the insert I-1 has a fluted inner surface 84 adjacent the center portion 86 along portions of its length to reduce the weight of the insert I-1 per unit length for like reasons as with the insert I.

As was the case with the insert I, the resilient material of the insert I-1 is of a closed cell synthetic resin sponge material as set forth above. Additionally, the elongate tube 70 of the insert I-1 has an outer surface 72 whose diameter when uncompressed is slightly larger than the interior diameter of the bat B. Thus, when the elongate tube 70 is inserted, it is compressibly fitted into the bat B.

Figure 10:
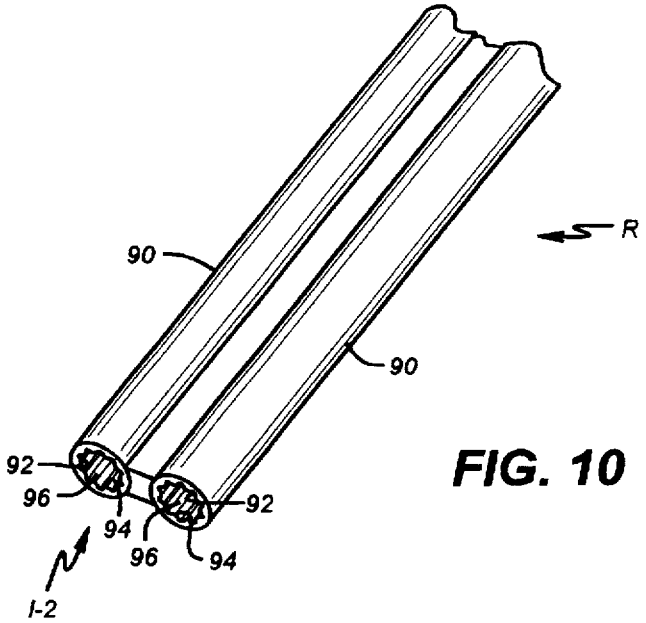
FIG. 10 is an isometric view of a sports racket having shock absorbent features according to the present invention.
Figure 2:
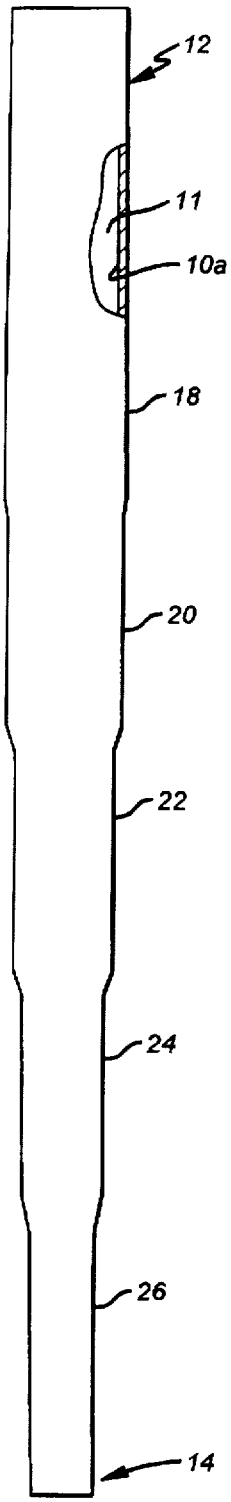
FIG. 2 is an elevation view, partially broken away, of the shaft of the golf club of FIG. 1.
Figure 3:
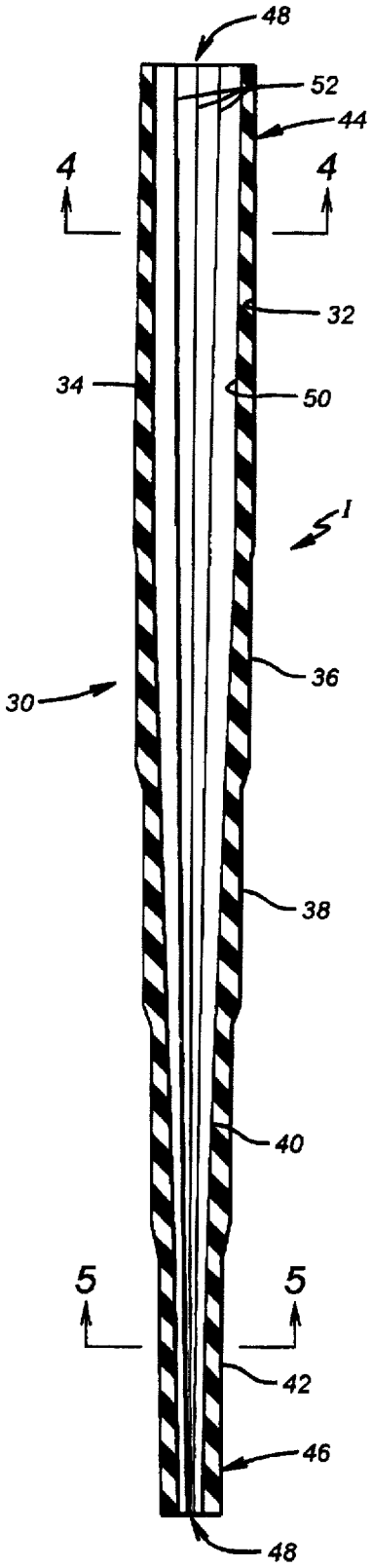
FIG. 3 is an elevation view, taken partly in cross-section of a shock absorbent insert according to the present invention for the golf club shaft of FIG. 2.
Figure 4:
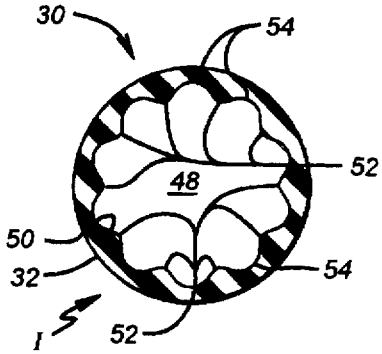
FIG. 4 is a view taken along the lines 4—4 of FIG. 3.
Figure 5:
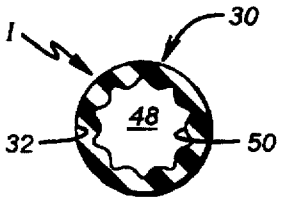
FIG. 5 is a view taken along the lines 5—5 of FIG. 3.
Figure 6:
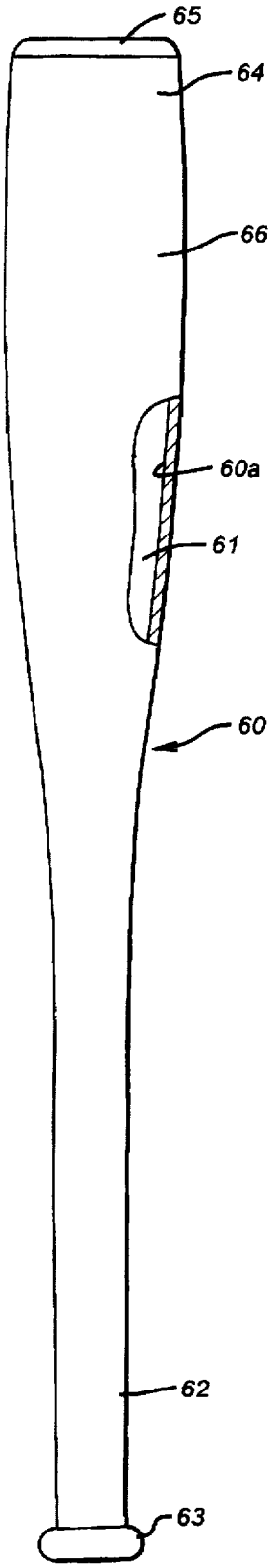
FIG. 6 is an elevation view, partially broken away, of a bat having shock absorbent features according to the present invention.
Figure 7:
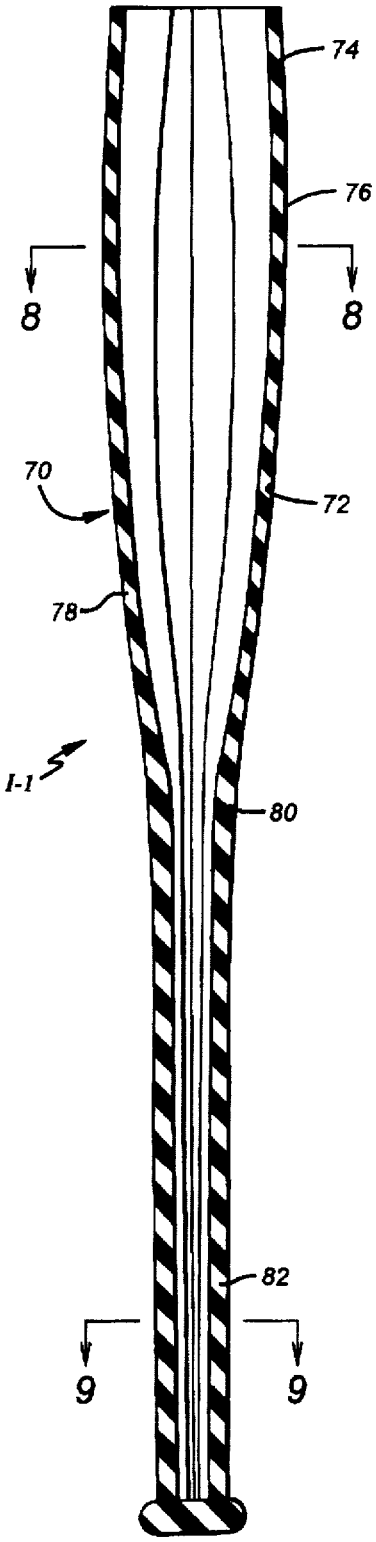
FIG. 7 is an elevation view, taken partly in cross-section, of a shock absorbent insert for the bat of FIG. 6.
Figure 8:
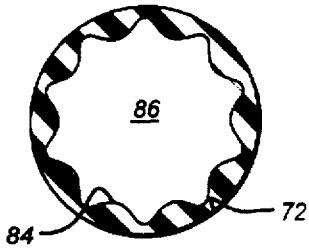
FIG. 8 is a view taken along the lines 8—8 of FIG. 7.
Figure 9:
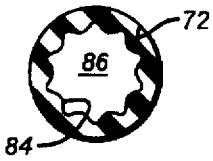
FIG. 9 is a view taken along the lines 9—9 of FIG. 7.

Finally, an insert I-2 for the racket R (FIG. 10) is compressively fitted within one or more shafts or hand grip tubes 90 adapted to be gripped by a user. The insert I-2 is formed of a tube 92 like material to the inserts I and I-1 and has fluted inner surfaces 94 adjacent a center passage or opening 96. The tube or tubes 92 of inserts I-1 extend inwardly into the shaft hand grip 90 a suitable distance comparable to the extent of hand grippable portions of the tubes. Because the insert or inserts I-1 are located within the hand, grip portions, they need not be tapered to achieve uniform mass per unit length. Such a mass per unit length achieved with uniform wall thickness.

Having described the invention above, various modifications of the techniques, procedures, material and equipment will be apparent to those in the art. It is intended that all such variations within the scope and spirit of the appended claims be embraced thereby.

I claim:

1. In an item of sporting goods having a shalt extending between a user's hand grip at one end to an opposite end, a shock absorbent insert for said shaft to absorb shock and vibrations when said item is used, said insert comprising:

an elongate tube of resilient material having an outer surface conforming to the interior of said shaft;

said elongate tube having a tapered inner surface along the extent of the shaft;

said elongate tube inner and outer surfaces having dimensions causing said tube to exhibit uniform mass per unit length along said shaft so that balance of said shaft in a user's hand is not affected by said insert.

2. The apparatus of claim 1, wherein said sporting goods item is a golf club having a club head at said opposite end of said shaft.

3. The apparatus of claim 2, wherein said golf club shaft is formed of a series of stepped diameter segments of decreasing diameter between said hand grip and said club head.

4. The apparatus of claim 2, wherein said golf club head comprises:

a back portion;

a club face segment; and a shock absorptive pad of resilient material attached between said back portion and said club face segment.

5. The apparatus of claim 4, wherein said resilient material of said shock absorptive pad and said elongate tube are of like material.

6. The apparatus of claim 1, wherein said sporting goods item is a baseball bat.

7. The apparatus of claim 1, wherein said sporting goods item is a softball bat.

8. The apparatus of claim 1, wherein said tapered inner surface of said elongate tube is fluted along at least portions of its length to reduce its weight per unit length.

9. The apparatus of claim 1, wherein said tapered inner surface of said elongate tube is fluted along the extent of its length to reduce its weight per unit length.

10. The apparatus of claim 1, wherein said resilient material comprises a closed cell synthetic resin sponge material.

11. A shock absorbent insert for a shaft of a sporting goods item extending between a user's hand grip an opposite end to absorb shock and vibrations when the item is used, said insert comprising:

an elongate tube of resilient material having an outer surface conforming to the interior of said shaft;

said elongate tube having a tapered inner surface along the extent of the shaft;

said elongate tube inner and outer surfaces having dimensions causing said tube to exhibit uniform mass per unit length along said shaft so that balance of said shaft in a user's hand is not affected by said insert.

12. The apparatus of claim 11, wherein said sporting goods item is a golf club having a club head at said opposite end of said shaft.

13. The apparatus of claim 12, wherein said golf club shaft is formed of a series of stepped diameter segments of decreasing diameter between said hand grip and said club head.

14. The apparatus of claim 11, wherein said sporting goods item is a baseball bat.

15. The apparatus of claim 11, wherein said sporting goods item is a softball bat.

16. The apparatus of claim 11, wherein said tapered inner surface of said elongate tube is fluted along at least portions of its length to reduce its weight per unit length.

17. The apparatus of claim 11, wherein said tapered inner surface of said elongate tube is fluted along the extent of its length to reduce its weight per unit length.

18. The apparatus of claim 11, wherein said resilient material comprises a closed cell synthetic resin sponge material.

19. A golf club, with reduced effect of vibration and shock on users, comprising:

a user's hand grip;

a golf club head;

a shaft extending between said user's hand grip at one end to said club head at an opposite end;

a shock absorbent insert for said shaft to absorb shock and vibrations when said golf club is used, said insert comprising:

an elongate tube of resilient material having an outer surface conforming to the interior of said shaft;

said elongate tube having a tapered inner surface along the extent of the shaft;

said elongate tube inner and outer surfaces having dimensions causing said tube to exhibit uniform mass per unit length along said shaft so that balance of said shaft in a user's hand is not affected by said insert; and said golf club head comprising:

a back portion;

a club face segment; and a shock absorptive pad of resilient material attached between said back portion and said club face segment.

20. The apparatus of claim 19, wherein said golf club shaft is formed of a series of stepped diameter segments of decreasing diameter between said hand grip and said club head.

* * * * *

UNITED STATES PATENT AND TRADEMARK OFFICE

CERTIFICATE OF CORRECTION

PATENT NO. : 5,692,971

DATED : 12/2/97

INVENTOR(S) : DANNY R. WILLIAMS

It is certified that error appears in the above-identified patent and that said Letters Patent is hereby corrected as shown below:

IN CLAIM 1, LINE 49, PLEASE DELETE "SHALT" AND INSERT THEREFOR --SHAFT--.

Signed and Sealed this

Third Day of February, 1998

Bruce Lehman

*Attest:*

BRUCE LEHMAN

*Attesting Officer*

*Commissioner of Patents and Trademarks*